United States Patent [19]

Jenkins

[11] 4,295,692

[45] Oct. 20, 1981

[54] DISHWASHER TUB ASSEMBLY

[75] Inventor: Thomas E. Jenkins, Louisville, Ky.

[73] Assignee: General Electric Company, Louisville, Ky.

[21] Appl. No.: 100,682

[22] Filed: Dec. 5, 1979

[51] Int. Cl.[3] ..... A47B 77/06; B08B 3/00

[52] U.S. Cl. ..... 312/228; 312/229; 312/311; 134/200; 220/72; 248/174

[58] Field of Search ..... 312/228, 229, 311, 351, 312/348; 134/200; 220/71, 72, 73, 84; 248/174, 152

[56] References Cited

U.S. PATENT DOCUMENTS

| | | | |
|---|---|---|---|
| 347,193 | 8/1886 | Penney | 312/228 |
| 2,988,411 | 6/1961 | Vannice | 312/348 |
| 3,089,632 | 5/1963 | Bartolucci | 248/174 |
| 3,181,541 | 5/1965 | Brooking | 134/200 |
| 3,331,529 | 7/1967 | Slapnik | 220/72 |
| 3,738,726 | 6/1973 | Burst et al. | 312/204 |
| 3,811,746 | 5/1974 | Butsch et al. | 312/228 |
| 3,822,029 | 7/1974 | Butsch | 220/72 |
| 3,826,553 | 7/1974 | Cushing et al. | 312/229 |
| 3,844,441 | 10/1974 | Clark | 220/72 |
| 4,187,122 | 2/1980 | Query | 134/200 |

FOREIGN PATENT DOCUMENTS

| | | | |
|---|---|---|---|
| 633911 | 1/1962 | Canada | 312/348 |

*Primary Examiner*—Victor N. Sakran

*Attorney, Agent, or Firm*—H. Neil Houser; Radford M. Reams

[57] ABSTRACT

A one-piece plastic dishwasher tub assembly which comprises a front-loading tub, a multi-rib frame, and base. The rib frame is integrally formed about the opening to the tub and the base is a box-like structure integrally formed on the bottom whereby the rigidity and cross-sectional shape of the tub are maintained.

12 Claims, 3 Drawing Figures

DISHWASHER TUB ASSEMBLY

BACKGROUND OF THE INVENTION

1. Field of the Invention

This invention relates to dishwasher tubs, and particularly to a new and improved plastic dishwasher tub assembly of one piece homogeneous construction comprising a plastic front-loading tub, a plastic multirib frame about the opening in the tub, and a plastic box-like base section, which combination of elements provides both ease of construction and proper structural support.

2. Description of the Prior Art

Plastic dishwasher tubs are in use in large capacity front-loading dishwashers of the type normally comprising upper and lower dish-supporting racks and a front swing-down door. Dishwashers of this type are disclosed in U.S. Pat. Nos. 3,811,746 and 3,826,553 assigned to the same assignee as the present invention.

The advantages of using a one-piece plastic dishwasher tub rather than a metal tub are numerous. For example, cost factors are greatly decreased in the manufacture of a molded plastic tub as compared to those involved in the manufacture of a metal tub, which requires an inner coating or lining operation. Other advantages include a reduction in finishing labor requirements, particularly tub welding operations, a longer tub life due to corrosion resistance which is independent of faulty coating procedures or chipping, and a decrease in thermal and acoustical transmission which minimizes the need for separate heat and sound insulation.

However, plastic tubs tend to deform. Deformation may occur when the tub is subjected to the high normal operating temperatures in a dishwasher, such as to approximately 180° F. Deformation may also occur when the tub is subjected to various loading forces, such as the weight of the dishwasher itself when placed on an uneven floor. Such deformation is undesirable and must be prevented for several reasons. More specifically, and in order for the swing-down door on a front-loading dishwasher to maintain a proper water seal to prevent leakage, the original cross-sectional rectangular shape of the tub must be maintained. Dish racks must be free to slide in and out of the dishwasher, an action which would be inhibited by tub deformation. Further, a tub which deforms under heat or load forces lacks an appearance or "feel" of quality.

The most commonly used means for preventing plastic tub deformation is the use of a metallic base and a metallic supporting collar placed around the tub. Although these measures effectively eliminate deformation, the use of metal members as a collar and base involves many of the same disadvantages which prompted change-over from metal to plastic tubs. These include not only corrosion related problems, but also the labor time required to mount the collar and base on the tub. Additionally, metallic parts must be manufactured separately from the plastic tubs and thus production and shipping costs are increased. Further, openings must be cut in metal bases in order to provide access to dishwasher components located underneath the tub, a step which requires even further labor time and cost.

The primary object of the present invention is to provide a new and improved plastic tub assembly including means for preventing deformation and thus maintaining the rectangular cross-section of such tubs.

Another object of the present invention is to eliminate the problem of corrosion inherent in a dishwasher tub assembly when metallic parts are used therein to maintain rigidity.

Another object of the present invention is to provide a one-piece plastic dishwasher tub assembly which eliminates the labor step of assembling the base and frame structure to the tub separately.

Still another object of the present invention is to provide a plastic dishwasher tub assembly with cutouts premolded into the base for allowing access to dishwasher components underneath the tub, and thus obviating the need for additional labor steps to provide such cutouts.

SUMMARY OF THE INVENTION

The present invention, in accordance with one embodiment thereof, comprises a plastic dishwasher tub assembly which includes an open-front plastic tub having a rectangular cross-section, a plastic multi-rib frame, and a box-like rectangular plastic base. The plastic tub frame is integrally formed on the outer periphery of the tub adjacent the open front thereof and serves to reduce distortion of the rectangular shape of the tub caused by high temperatures and external forces applied to the tub. The plastic base is integrally formed on the underside of the tub and provides rigid axial support for the tub, and thus also assists in maintaining the rectangular cross-sectional shape of the tub. The base additionally provides elevation for the tub and a support structure for the various components mounted beneath the tub and required to operate the dishwasher as well as means of access to such components through cut-outs in the base. The entire plastic tub assembly preferably is molded as a homogeneous one-piece unit.

BRIEF DESCRIPTION OF THE DRAWING

This invention will be better understood from the following description taken in conjunction with the accompanying drawing and its scope will be pointed out in the appended claims.

DESCRIPTION OF THE PREFERRED EMBODIMENT

Figure 1:
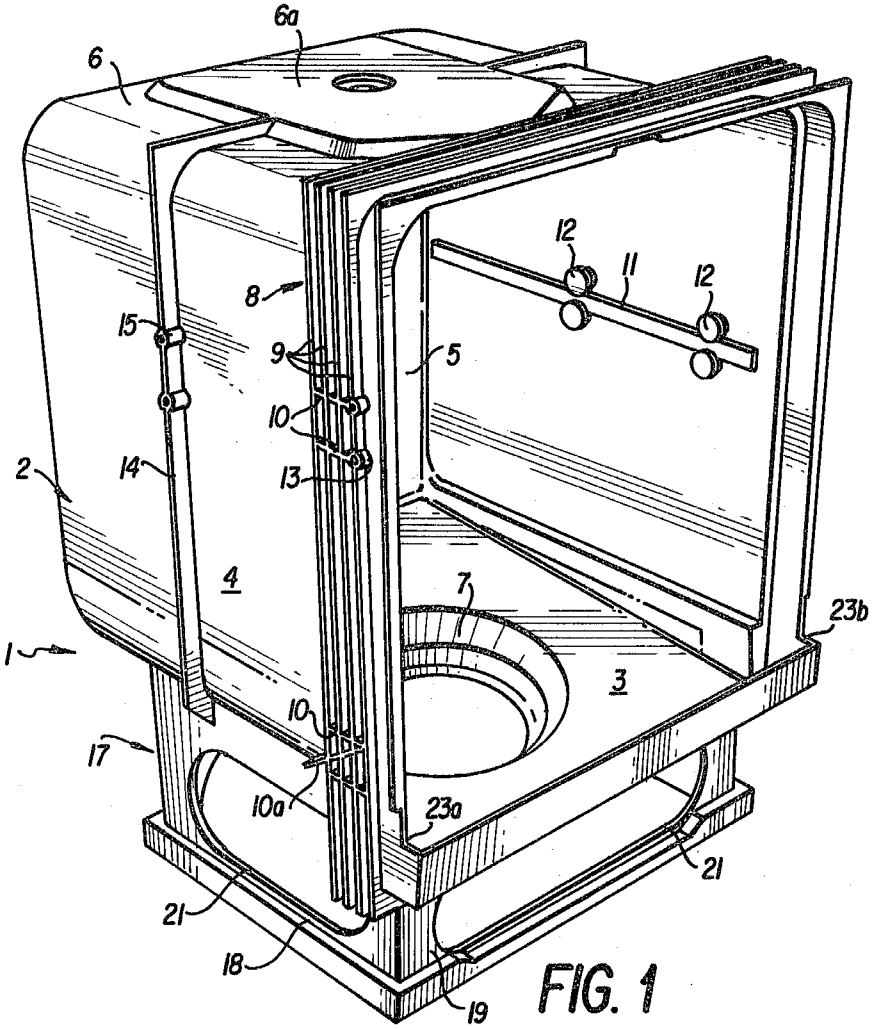
FIG. 1 is a front perspective view of a dishwasher tub assembly including a multi-rib frame and a box-like base structure according to the present invention.

Turning now to a consideration of the drawing, and in particular to FIG. 1, there is shown a dishwasher tub assembly 1 which includes an open front plastic tub 2 of rectangular cross-section defined by a lower wall 3, opposed side walls 4, a rear wall 5, and an upper wall 6. The walls of the tub 2 can have portions offset in order to improve structural strength or to accommodate dishwasher components. An example of this is shown as an upper wall portion **6*a* offset from the upper wall 6. Service openings may be located in various locations in the tub 2 as required, as for example, the service opening 7 shown in the lower wall 3** which is provided for mounting a dishwasher spray unit in the tub.

Formed on the external periphery of the tub 2 and located adjacent the front opening thereof is a plastic multi-rib frame 8. The rib frame 8 accomplishes one of the principal purposes of the invention, namely, to rigidize the tub 2 and thus maintain the rectangular cross-sectional shape of the tub even when high temperatures or shear forces or other loads are applied to the tub. Each rib 9 of the multi-rib frame 8 which surrounds the tub 2 preferably is a flat flange of plastic, the outer edges of which define a rectangle and the inner edges of which extend from the outer surfaces of the lower wall 3, opposed side walls 4 and the upper wall 6. The plane of each plastic rib 9 of the frame 8 is parallel to the planes of the other ribs 9 and perpendicular to the planes of the walls 3, 4 and 6. Although four ribs, spaced closely to and substantially equidistantly from each other, constitute the rib frame 8 shown in FIG. 1, the number of and spacing between the ribs 9 may be altered as necessary, depending upon the degree of rigidity required.

Between and abutting the ribs 9 of the rib frame 8 are the cross-ribs 10. The cross-ribs 10 are formed of the same material as are the ribs 9 at locations around the rib frame 8 where extra rigidity is required. Each cross-rib 10 comprises a flange or a longitudinal series of flanges extending perpendicularly from a wall of the tub 2 and intersecting the ribs 9 at any desired angle. As shown in FIG. 1 at 10*a*, the cross-ribs 10 can also be formed to extend ahead of or behind the ribs 9, as well as intersecting them, in order to increase structural rigidity. As also shown in FIG. 1, examples of suitable locations for the cross-ribs 10 are at the lower sides of the rib frame 8, adjacent the area of the tub 2 where the dishwasher door is hinged, and intermediate the ends of the sides of the rib frame 8, adjacent the area of the tub 2 where the upper dishwasher rack is mounted.

Mounted on each side wall 4 within the tub 2 is a rack support track 11. The track 11 guides and partially supports an upper dishwasher rack (not shown). Rotatable means, such as the rollers 12, are mounted adjacent the track 11, thusly both enabling the dishwasher rack to easily slide in and out of the tub 2 along the track 11 and providing support for the rack. Since the rollers 12 support a large part of the weight of the dishwasher rack, they must be sturdily mounted on the tub 2 so as to prevent structural damage to the tub walls. Two such appropriate mountings for the rollers 12 are shown in FIG. 1. A cross-rib 10 is modified slightly for each roller adjacent the rib frame 8 so as to include a lug or a hollow cylindrical section 13 through which a screw or bolt connected to the roller is inserted. Where rollers are to be mounted at a point not adjacent rib frame 8, a support rib 14 is additionally formed adjacent those rollers. The support ribs 14 are substantially the same as the ribs 9 except that they do not necessarily surround the tub 2. Rather, since their primary function is support of the rollers 12, they need only be formed on the sides of the tub 2. Each support rib 14 is a flat flange of plastic extending perpendicularly from the side wall 4 and includes a lug or a hollow cylindrical section 15 through which a screw or bolt connected to a roller is inserted.

Figure 2:
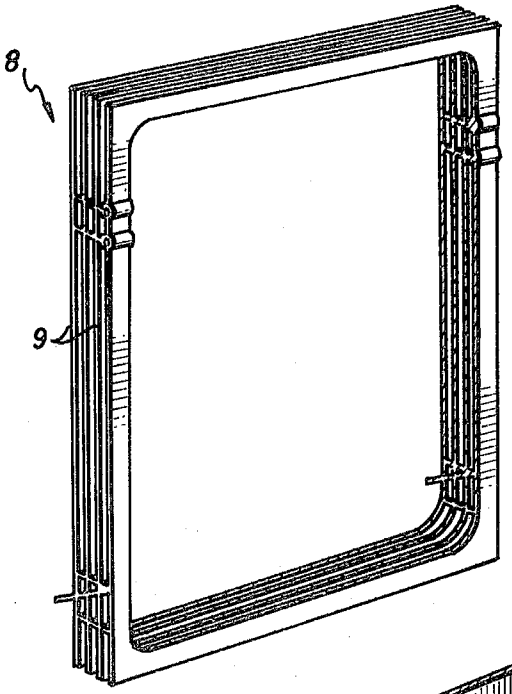
FIG. 2 is a fragmentary front perspective view of the multi-rib frame.
Figure 3:
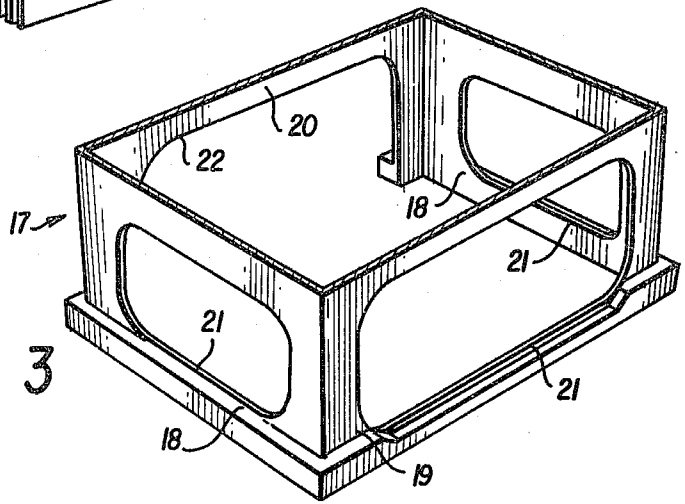
FIG. 3 is a fragmentary front perspective view of the base structure.

Formed off the bottom side of the tub 2 is a plastic base 17. The base 17 not only elevates the tub 2 sufficiently to allow mounting of dishwasher components beneath the tub, but it also, in combination with the rib frame 8, assists in maintaining the rectangular cross-sectional shape of the tub 2 by providing rigid support of the tub about the vertical axis thereof. Preferably, the base 17 is a hollow box-like structure defined by opposing side sections 18, a front section 19, and a rear section 20, with an open bottom, and with horizontal dimensions approximating those of the lower wall 3 of the tub 2. Cut-outs may be provided in the base sections to reduce weight and to facilitate access to dishwasher components mounted under the tub 2. Examples of such cut-outs are shown in FIGS. 1 and 3 as generally rectangular openings 21 in both opposing side sections 18 and the front section 19 and as a generally semi-elliptical opening 22 in the rear section 20.

The surfaces 23*a* and 23*b* in FIG. 1 denote lateral locations on the tub 2 where a front-opening dishwasher door may typically be hinged. The weight of a door so hinged as well as the weight of objects placed on the door will impose additional stresses on the tub 2 at the surfaces 23*a* and 23*b*. In order to adapt the tub for better withstanding such stresses, the multi-rib frame 8 and the base 17 are formed off the tub 2 in such a manner that the sides of the frame extend downward alongside of the surfaces 23*a* and 23*b* and are integral also with the sides of the base. This results in regions of substantial rigidity at adjacent surfaces 23*a* and 23*b* where the frame, base and tub are contiguous.

In FIG. 1, the rib frame 8, the cross-ribs 10, the support ribs 14, and the base 17 are shown as integrally formed on the tub 2. Preferably, the entire dishwasher tub assembly 1 comprises a single molded unit of homogeneous one-piece construction. One example of material of which the tub assembly 1 may be formed is talc-filled polypropylene. However, it is to be understood that other methods of forming and other plastic materials may be suitably employed for providing a rib frame 8, cross-ribs 10, support ribs 14, and a base 17 on the tub 2. For example, the tub, frame ribs, and base can for some applications be separately formed and effectively joined together by heat welding or by riveting. Additionally, while the base 17 has been shown as having a rectangular box-like construction, it could be other than rectangular, such as cylindrical or any other suitable hollow box-like configuration.

It is to be understood that this invention is not limited to the particular embodiment disclosed, and it is intended to cover all modifications coming within the true spirit and scope of this invention as claimed.

What is claimed is:

1. A dishwasher tub assembly comprising a plastic dishwasher tub having a generally rectangular cross-section and an open front, a plastic supporting rib frame comprising a plurality of spaced apart plastic ribs formed on the external periphery of said tub adjacent the front opening thereof, and a box-like plastic base structure comprising the bottom wall of said tub in combination with adjacent side walls extending downwardly from said bottom wall of said tub.

2. The dishwasher tub assembly of claim 1, wherein said plastic tub frame comprises a plurality of ribs extending parallel to and spaced substantially equidistantly from each other.

3. The dishwasher tub assembly of claim 1, wherein each said plastic rib comprises a flat flange, the outer edges of which form a rectangle, the inner edges of which are integral with the outer surfaces of the side walls of the tub, and the plane of which extends perpendicular to the plane of the top, bottom and opposing side walls of the tub.

4. The dishwasher tub assembly of claim 1, further comprising at least one plastic cross-rib formed on the external periphery of said tub, extending between said plurality of ribs and intersecting said plurality of ribs at an angle thereto.

5. The dishwasher tub assembly of claim 4, wherein said cross-rib includes at least one hollow section extending perpendicular to the wall of said tub.

6. The dishwasher tub assembly of claim 1, wherein said base comprises a generally hollow box-like structure with horizontal dimensions approximating those of said bottom wall of said tub, and the top edges of which are integrally joined to a major portion of the edges of the lower wall of said tub.

7. The dishwasher tub assembly of claim 6, wherein said base further comprises an open bottom section, and openings formed in the front side, and rear sections thereof.

8. The dishwasher tub assembly of claim 1, wherein said tub includes laterally located hinge mounting surfaces adjacent said base, and said frame includes portions thereof which extend adjacent said hinge mounting surfaces and are integral with said base.

9. The dishwasher tub assembly of claim 1, wherein said plastic tub, rib frame, and base comprise a single unit of homogeneous one-piece construction.

10. A dishwasher tub assembly comprising a plastic open front tub having a generally rectangular cross-section;

a plastic supporting rib frame comprising a plurality of ribs extending parallel to and spaced equidistantly from each other formed on the external periphery of said tub adjacent the front opening thereof;

a plurality of plastic cross-ribs formed on the external periphery of said tub and intersecting said rib frame at an angle thereto;

plastic support ribs formed on the external periphery of each side of said tub spaced apart from said rib frame;

a plastic base mounted on the bottom of said tub comprising a generally hollow box-like structure with horizontal dimensions approximating those of the lower wall of said tub, and having an open bottom generally rectangular cut-outs in the front and two side sections, and a generally semielliptical cut-out in the rear section; and said plastic tub, rib frame, cross-ribs, support ribs, and base comprising a single unit of homogeneous one-piece construction.

11. The dishwasher tub assembly of claim 10, wherein said cross-ribs include at least one hollow section extending perpendicular to the wall of said tub.

12. The dishwasher tub assembly of claim 10, wherein said support ribs include at least one hollow section extending perpendicular to the side wall of said tub.

* * * * *